US005806667A

United States Patent [19]

Marco

[11] Patent Number: 5,806,667

[45] Date of Patent: Sep. 15, 1998

[54] CONTAINER CARRIER WITH TOP LIFT HANDLE

[75] Inventor: Leslie S. Marco, Bloomingdale, Ill.

[73] Assignee: Illinois Tool Works Inc., Glenview, Ill.

[21] Appl. No.: 795,468

[22] Filed: Feb. 4, 1997

[51] Int. Cl.[6] ..... B65D 75/00

[52] U.S. Cl. ..... 206/150; 294/87; 220/DIG. 29

[58] Field of Search ..... 206/150, 141, 206/145, 151, 161, 162, 199; 294/87.2; 220/DIG. 29; 383/107

[56] References Cited

U.S. PATENT DOCUMENTS

| | | | |
|---|---|---|---|
| 2,994,426 | 8/1961 | Biesecker et al. | 206/150 |
| 4,782,955 | 11/1988 | Weaver et al. | 206/161 |
| 5,437,364 | 8/1995 | Broskow | 206/162 |
| 5,467,870 | 11/1995 | Broskow et al. | 206/162 |
| 5,487,465 | 1/1996 | Broskow | 206/150 |
| 5,593,026 | 1/1997 | Broskow | 206/150 |
| 5,642,808 | 7/1997 | Marco et al. | 206/150 |
| 5,651,453 | 7/1997 | Olsen | 206/150 |
| 5,653,334 | 8/1997 | Marco | 206/150 |
| 5,655,654 | 8/1997 | Broskow | 206/150 |
| 5,657,863 | 8/1997 | Olsen | 206/150 |

*Primary Examiner*—Paul T. Sewell
*Assistant Examiner*—Nhan T. Lam
*Attorney, Agent, or Firm*—Trexler, Bushnell, Giangiorgi & Blackstone, Ltd.

[57] ABSTRACT

A plastic carrier for carrying a plurality of containers, such as cans, bottles and the like, includes a novel structure which maintains a straight grip portion when containers are applied thereto. The carrier includes container engaging portions which are joined to a handle portion by a welded seam. Each container engaging portion includes bands which define apertures therein for holding the containers therein. The handle portion extends generally perpendicular to the container engaging portions when the carrier is applied to the containers. The apertures within each container engaging portion include an inner aperture and a pair of end apertures therein. Each inner and outer aperture is defined by a length measured parallel with the welded seam wherein each inner aperture is substantially shorter than each end aperture. The handle portion includes a pair of inner strut portions which connect the welded seam to the grip portion and transfer tension force, manifested by the application of a container to the inner aperture, to the grip portion to generally straighten the grip portion.

10 Claims, 3 Drawing Sheets

CONTAINER CARRIER WITH TOP LIFT HANDLE

BACKGROUND OF THE INVENTION

This invention is generally directed to a novel top-lift carrier which secures containers, such as cans, bottles or the like, together into a package, wherein a handle portion of the carrier does not noticeably buckle or wrinkle when the containers are applied thereto.

Currently, several types of carriers can be found in the art for securing containers together into a package. One example of a prior art carrier 11 is shown in FIGS. 1 and 2.

The carrier 11 includes a handle portion 18 and a pair of container engaging portions 15, 16 having a plurality of bands 3 defining apertures 12 therein, each of which holds a single container 17. The container engaging portions 15, 16 between adjacent apertures 12 define side margins 4. The prior art carrier 11 is formed from two sheets resulting in the handle portion 18 having a double thickness and the pair of container engaging portions 15, 16 joined to the handle portion 18 at a welded seam 14 and freely extending therefrom.

The handle portion 18 includes a grip portion 19 which is attached to the welded seam 14 by a pair of inner struts 8, 10 and a pair of outer straps 7, 9. The inner strut portions 8, 10 attach the welded seam 14, adjacent to the side margins 4 of the inner aperture 12, with the outer extents of the grip portion 19. The outer strap portions 7, 9 connect the outermost extents of the grip portion 19 to the outermost extents of the welded seam 14. Length A shown on FIG. 2 represents the length between the outermost edges of the inner strut portions 8, 10 where the inner strut portions 8, 10 join with the seam 14. As shown in FIG. 2, length A exceeds the diameter D of a single container 17 which is to be held in the carrier 11.

Length L represents the length of an individual aperture 12, with each aperture 12 formed in the carrier 11 being identical in length so that when the container 17 is placed therein each band 3 is equally stretched around the container 17. The aperture length L is less than the container diameter D to secure the containers 17 within the carrier 11.

When the containers are applied to the carrier 11 as shown in FIG. 1, the bands 3 forming the container engaging portions 15, 16 deform as they are stretched over each container 17 to foreshorten the carrier 11. The welded seam 14 buckles when the carrier is foreshortened. This causes the inner struts 8, 10 to lean inwardly toward each other and generally toward the center of the carrier 11, thereby causing the grip portion 19 of the carrier 11 to buckle or wrinkle.

The buckled grip portion 19, as shown in FIG. 1, is wavy in appearance and difficult for a consumer to grasp. The grip portion 19, when wavy, can conform to the container profiles and a consumer must then disengage the grip portion 19 away from the containers 17 before inserting his or her fingers around the grip portion 19 to lift the package. The wavy grip portion 19 and wavy welded seam 14 also gives the overall package a slovenly appearance since the containers 17 are uniformly in rows while the handle portion 18 and welded seam 14 are wrinkled and wavy.

The present invention presents a novel structure for providing a straight handle portion for a carrier which overcomes the problems presented by the prior art and presents several other novel advantages and features.

OBJECTS AND SUMMARY OF THE INVENTION

A general object of the present invention is to provide a novel, plastic top-lift carrier for carrying a plurality of containers, such as cans, bottles or the like, which provides a straight handle portion between adjacent container rows when the containers are applied thereto, so that the package can be easily and quickly lifted.

Another general object of the present invention is to provide a novel plastic, top-lift carrier which provides a straight handle portion between adjacent container rows when the containers are applied to the carrier so that the resulting package is uniform in appearance.

Briefly, and in accordance with the foregoing, the present invention discloses a novel carrier for carrying a plurality of containers, such as cans, bottles and the like, which includes a pair of container engaging portions freely extending from a handle portion and joined to the handle portion at a welded seam. When the containers are applied to the carrier, the container engaging portions extend generally perpendicular to the welded seam and handle portion.

Each container engaging portion includes annular rings or bands which define at least one inner aperture and a pair of end apertures. Each band engages a side wall of a single container to hold the container therein. Each band has an inner margin portion, an outer margin portion and side margin portions. The inner margin portions of adjacent bands of each container engaging portion are joined together to form a continuous inner margin along the length of the carrier. The outer margin portions of each container engaging portion are joined together to form a continuous outer margin along the length of the carrier. The side margin portions of adjacent bands are integrally formed with each other. The aperture length of each inner aperture is shorter than the aperture length of each end aperture which results in increased stretch on the inner margin portions of the bands defining the inner apertures when containers are applied thereto.

A tear strip, which is used to release the containers from the carrier, is provided on the continuous outer margin of each container engaging portion. The tear strip allows a consumer to quickly and easily remove the containers from the carrier.

The handle portion of the carrier has a grip portion, a pair of inner strut portions and a pair of outer strap portions. The outer strap portions connect the outermost extents of the welded seam to the outermost extents of the grip portion. The inner strut portions attach the welded seam, proximate to the inner aperture or apertures, with the outer extents of the grip portion.

When containers are applied to the carrier, the containers placed in each inner aperture stretch the inner margin proximate thereto. Tension forces within the stretched inner margins proximate to the inner apertures transfer through the strut portions to the grip portion, thereby creating a resultant tension force in the grip portion which generally straightens the grip portion and substantially eliminates the waviness which occurs in the handle portions of prior art carriers.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
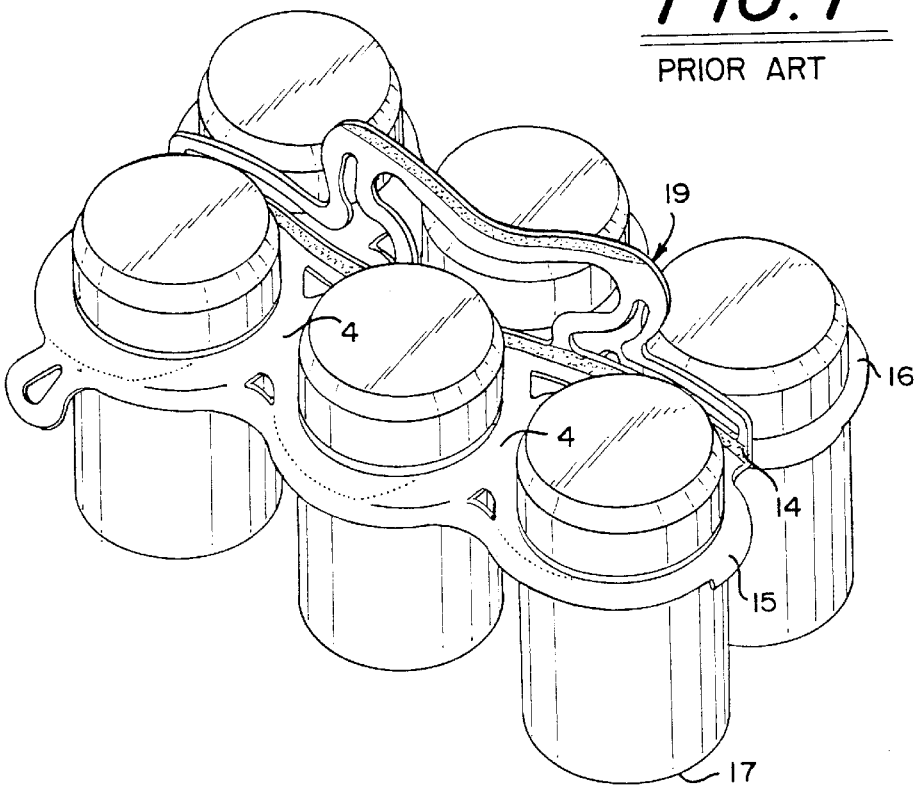
FIG. 1 PRIOR ART
FIG. 1 is a perspective view of a prior art carrier illustrating the problems found in the prior art.
Figure 2:
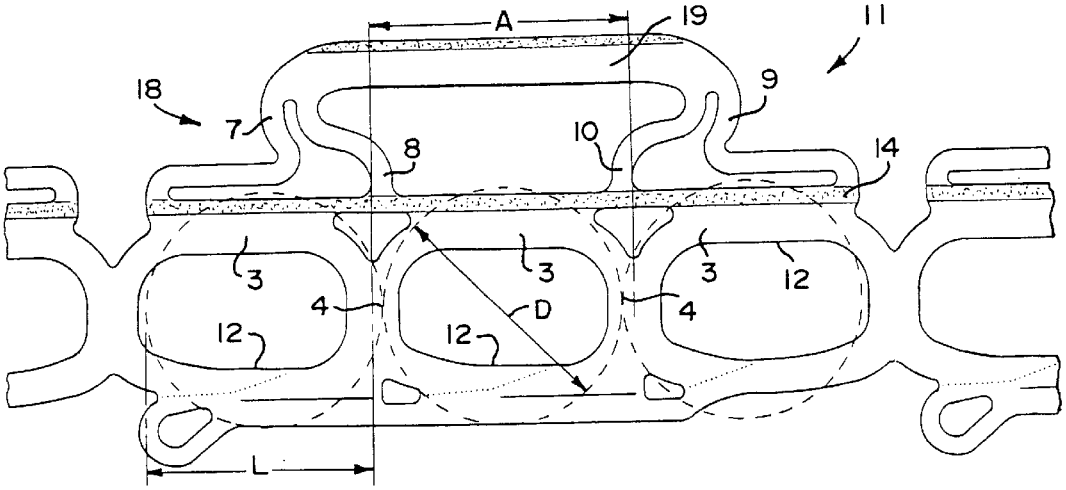
FIG. 2 PRIOR ART
FIG. 2 is a partial elevational view of a plurality of the prior art carriers shown in FIG. 1 and shown in a flattened configuration.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 3:
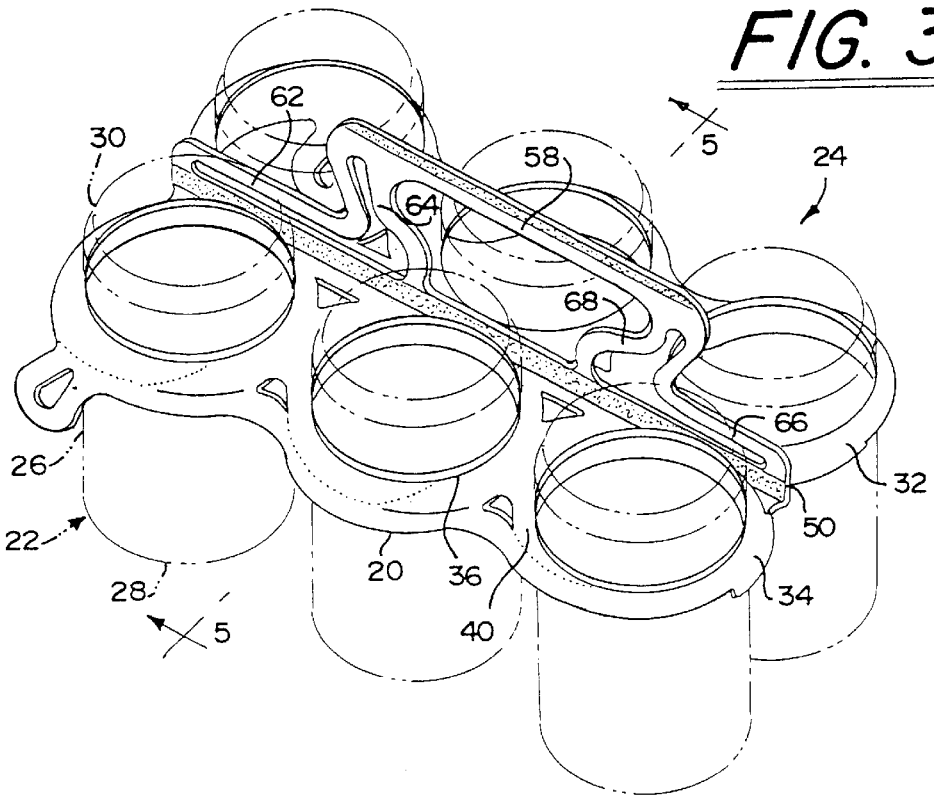
FIG. 3 is a perspective view of a novel top-lift carrier formed in accordance with a first embodiment of the present invention and shown surrounding a plurality of containers, shown in phantom lines, to form a package.
Figure 4:
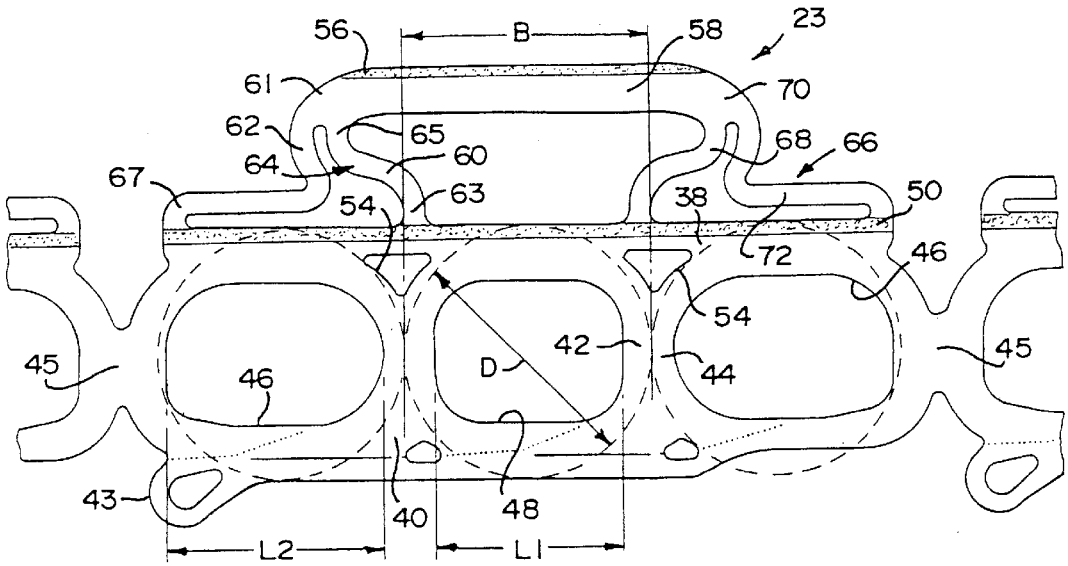
FIG. 4 is an elevational view of the carrier of FIG. 3 shown in a flattened configuration and connected to adjacent like carriers.
Figure 5:
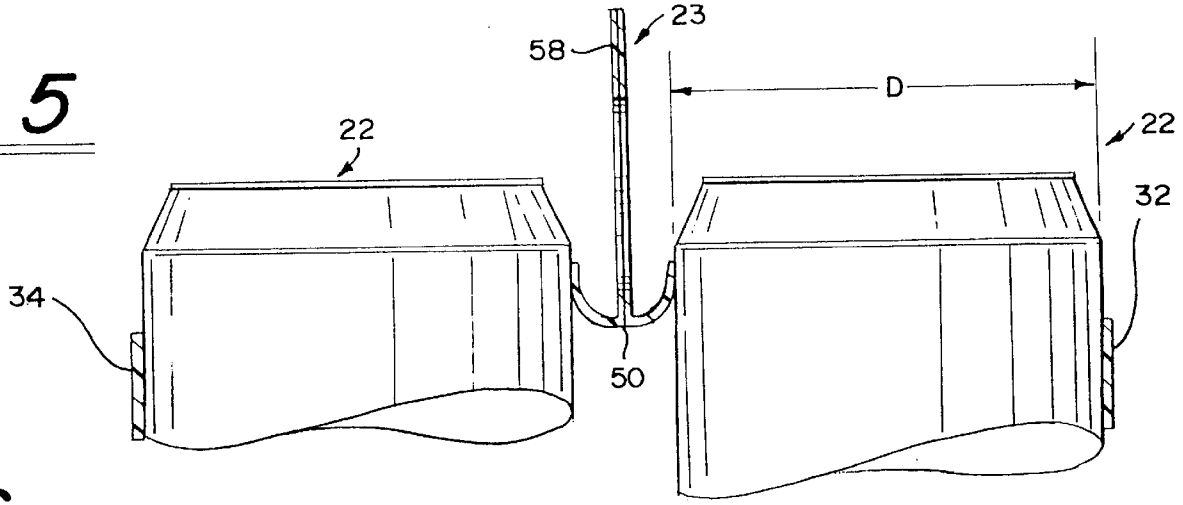
FIG. 5 is a cross-sectional view of the carrier along line 5—5 of FIG. 3.
Figure 6:
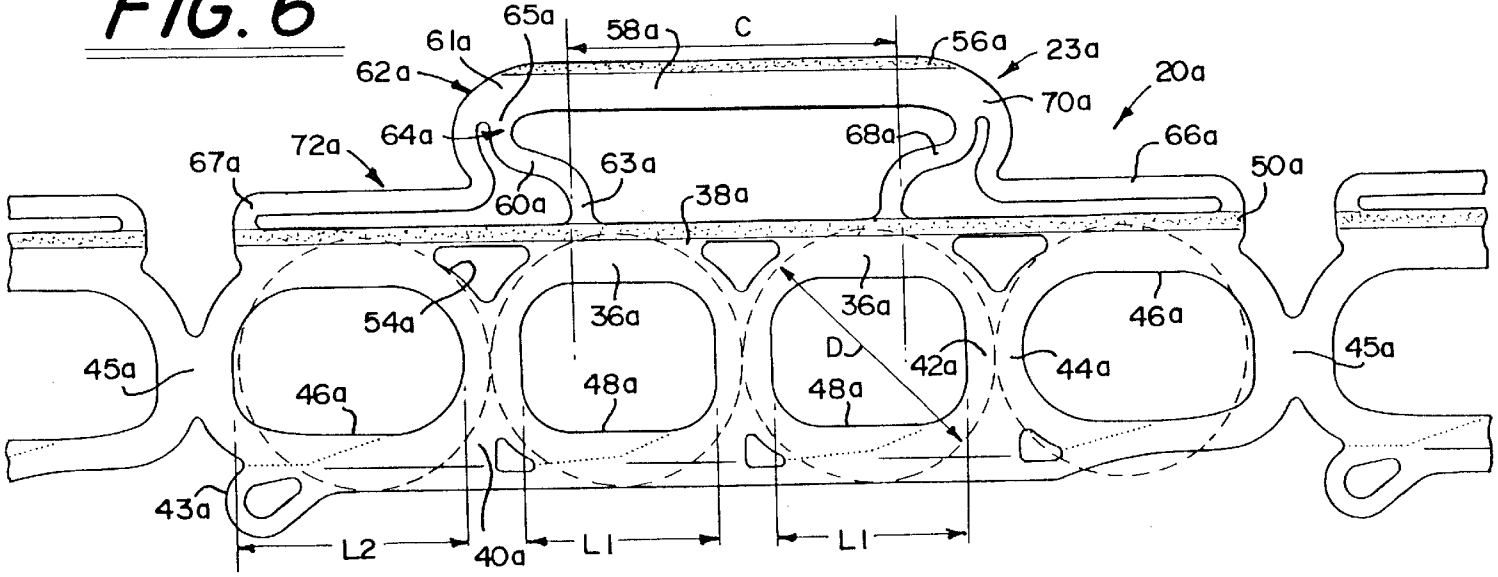
FIG. 6 is a partial elevational view of a novel top-lift carrier in a flattened configuration which incorporates the features of a second embodiment of the invention.

As shown in FIG. 3, a multi-packaging device or carrier device 20, constructed in accordance with the present invention, is shown holding a plurality of containers 22, shown as cans, to form a package 24. The carrier 20 provides a novel structure for maintaining a handle portion 23 of the carrier device 20 straight when containers 22 are applied thereto, however, the overall length of the carrier is the same as prior art carriers. A first embodiment of the carrier 20 is shown in FIGS. 3, 4 and 5 and is used to hold and carry six containers 22. A second embodiment of the carrier 20*a* is shown in FIG. 6 and is used to hold and carry eight containers. Like elements in each embodiment are denoted by like reference numerals with the like elements of the second embodiment having the suffix "a" thereafter.

Each container 22 includes a side wall 26, a bottom wall 28 and a top 30. Each container 22 also has a predetermined diameter D common to each container 22, as shown in FIGS. 4, 5 and 6. While cans are illustrated in the drawings, it is to be understood that other types of containers can be carried by the novel top-lift carrier 20, 20*a*, such as bottles and the like.

Each carrier 20, 20*a* includes a handle portion 23 having a pair of container engaging portions 32, 34 freely extending therefrom and joined thereto at a welded seam 50. Each carrier 20, 20*a* is made of a suitable flexible, resilient, stretchable material, such as plastic. Preferably, the carrier 20, 20*a* is made of a low density polyethylene so that the carrier 20, 20*a* can be stretched over the containers 22 and conform to the side walls 26 of the containers 22. The carrier 20, 20*a* may be applied to the containers 22 by known means, for example, by the machines disclosed in U.S. Pat. Nos. 4,250,682 or 3,204,386.

When the containers 22 are secured to the carrier 20, 20*a* in a package arrangement, the containers 22 are aligned in an array to form two rows. As shown in FIG. 3, in the first embodiment of the carrier 20, each row has three containers 22, and as shown in FIG. 6, in the second embodiment of the carrier 20*a*, each row is designed to hold four containers.

The general structure of the embodiments of the carrier 20, 20*a* is described with respect to the first embodiment of the carrier 20 for convenience in explanation. The second embodiment of the carrier 20*a* has a like structure except for the differences noted herein.

Each container engaging portion 32, 34 is formed from a plurality of annular rings or bands 36 defining a plurality of apertures 46, 48 therein. Each band 36 has an inner margin 38, an outer margin 40 and side margins 42, 44 which connect the inner margin 38 of each band 36 to the outer margin 40 of the same band 36. The side margins 42, 44 of adjacent bands 36 are integrally joined together so that the inner and outer margins 38, 40 of the container engaging portions 32, 34 are respectively continuous and uninterrupted along the length of the carrier 20. The inner margin 38 of each container engaging portion 32, 34 may include cutouts 54 proximate to the welded seam 50.

The bands 36 on each container engaging portion 32, 34 define a pair of rectangularly-shaped end apertures 46 and a single rectangularly-shaped inner aperture 48 (for the embodiment of the carrier 20 shown in FIGS. 3 and 4). The embodiment of the carrier 20*a*, shown in FIG. 6, has a pair of rectangularly-shaped end apertures 46*a* and a pair of rectangularly-shaped inner apertures 48*a*. The length of each aperture 46, 48 runs parallel to the seam 50. Each end aperture 46 has a length L2 that is identical. As shown in FIG. 4, the length L1 of the inner aperture 48 is substantially reduced compared to the length L2 of each end aperture 46 when containers 22 are not attached to the carrier 20. The width of each aperture 46, 48 is identical. The length of each of the end apertures 46 and the inner aperture 48 are substantially shorter than the container diameter D to provide an interference fit so that the containers 22 will be tightly held by the carrier 20 when engaged therewith.

As shown in the drawings, attached to the outer margins 40 of each container engaging portion 32, 34 is a tear strip 43 for removing the containers 22 from the carrier 20. The tear strip 43 can be made in accordance with the U.S. patent application Ser. No. 08/391,137, entitled "Ring Container Multipack With Perforated Tear Strip for Container Removal" and owned by the assignee herein and which disclosure is incorporated herein by reference. The tear strip 43 can be eliminated, if desired.

The handle portion 23 includes a grip portion 58, a pair of inner strut portions 64, 68 and a pair of outer strap portions 62, 66. The inner strut portions 64, 68 and the outer strap 62, 68 portions are connected between the grip portion 58 and the welded seam 50 as described herein.

Now directing attention to the specifics of the first embodiment of the carrier 20, shown in FIGS. 3 and 4, each inner strut portion 64, 68 has a first end 63 joined to the welded seam 50 and a second end 65 joined to the grip portion 58. The first and second ends 63, 65 of the inner strut portions 64, 68 are connected by a generally S-shaped curvilinear portion 60 formed from a pair of arcuate segments. It is within the scope of the invention, however, for each strut portion 64, 68 to be generally straight.

The first ends 63 of each inner strut portion 64, 68 connect with the welded seam 50 proximate to the side margins 42, 44 of the inner aperture 48. Directing attention to FIG. 4, the distance between the outermost extents of the first ends 63 of the inner strut portions 64, 68 is defined by a length B which is measured where the outermost extents of the strut portions 64, 68 join the welded seam 50. Length B is equal to or less than the diameter D of a container 22 which is to be attached within the inner aperture 48. Each second end 65 of the inner strut portions 64, 68 is connected to opposite ends of the grip portion 58.

Each outer strap portion 62, 66 has a first end 67 joined to the seam 50 and a second end 61 joined to the grip portion 58. The first and second ends 67, 61 of the outer strap portions 62, 66 are connected by a generally L-shaped curvilinear portion 72. It is within the scope of the invention to have generally straight strap portions 62, 66.

The first ends 67 of the outer strap portions 62, 66 are connected to the welded seam 50 at the opposite ends of the welded seam 50 and are substantially spaced apart from the first ends 63 of the inner strut portions 64, 68. The second ends 61 of the outer strap portions 62, 66 are attached to the outermost ends of the grip portion 58. The second ends 61 of the outer strap portions 62, 66 are respectively generally located outside of the second ends 65 of the inner strut portions 64, 68 and attach at a location 70.

The novel structure for maintaining the handle portion 23 in a generally straight configuration includes inner margin 38 adjacent to the single inner aperture 48 of each container engaging portion 32, 34, the inner strut portions 64, 68 and the grip portion 58. The novel maintaining means or grip straightening structure transfers tension force from the welded seam 50 at the center of the carrier 20 to the grip portion 58 when containers 22 are applied to the carrier 20. When containers 22 are applied to the carrier 20, the carrier 20 would normally foreshorten at the welded seam 50, however, because the inner aperture 48 is shorter in length than the end apertures 46 and the length B is equal to or less than the container diameter D, this causes the inner margin 38 proximate to the inner aperture 48 to stretch and cause a tension force therein. This tension force is transferred to the inner strut portions 64, 68 which transfer the tension force to the outermost extents of the grip portion 58, exerting the tension force along the length of the grip portion 58 and generally straightening the grip portion 58.

The outer strap portions 62, 66 are placed generally outside of the inner strut portions 64, 68 to avoid the strap portions 64, 68 transmitting tension forces to the grip portion 58. The first ends 67 of the outer strap portions 62, 66 attach to the welded seam substantially away from first ends 63 of the inner strut portions 64, 68 to both stabilize the grip portion 58 and avoid transmitting force to the grip portion 58.

Attention is now directed to the specifics of the second embodiment of the carrier 20*a* shown in FIG. 6. The second embodiment of the carrier 20*a* is used to hold and carry eight containers 22 to form a package. Each container engaging portion 32*a*, 34*a* has bands 36*a* which define a pair of rectangularly-shaped inner apertures 48*a* and a pair of rectangularly-shaped end apertures 46*a*. The length of each inner aperture 48*a* is substantially reduced compared to the length of each end aperture 46*a* when the carrier 20*a* is not attached to the containers 22. The length of the end apertures 46*a* and the inner apertures 48*a* are substantially shorter than the container diameter D to provide an interference fit so that the containers 22 will be tightly held by the carrier 20*a*.

Each inner strut portion 64*a*, 68*a* has a first end 63*a* joined to the welded seam 50*a* and a second end 65*a* joined to the grip portion 58*a*. The first and second ends 63*a*, 65*a* of the inner strut portions 64*a*, 68*a* are connected by a generally S-shaped curvilinear portion 60*a* formed from a pair of arcuate segments. It is within the scope of the invention, however, for each strut portion 64*a*, 68*a* to be generally straight.

The first ends 63*a* of each inner strut portion 64*a*, 68*a* connect with the welded seam 50*a* proximate to each pair of side margins 42*a*, 44*a*, located between the inner and end apertures 48*a*, 46*a*, respectively. Directing attention to FIG. 6, the distance between the outermost extents of the first ends 63*a* of the inner strut portions 64*a*, 68*a* is defined by a length C which is measured from where the outermost extents of the strut portions 64*a*, 68*a* join the welded seam 50*a*. Length C is equal to or less than twice the diameter D of a single container 22 which are to be attached within the inner apertures 48*a*. Each second end 65*a* of the inner strut portions 64*a*, 68*a* are connected to the grip portion 58*a* at the outermost extents of the grip portion 58*a*.

The novel structure for maintaining the handle portion 23*a* in a generally straight configuration includes the inner margin 38*a* adjacent to the pair of inner apertures 48*a* of each container engaging portion 32*a*, 34*a*, the inner strut portions 64*a*, 68*a* and the grip portion 58*a*. The novel maintaining means or grip straightening structure transfers tension force from the welded seam 50*a* at the center of the carrier 20*a* to the grip portion 58*a* when containers 22 are applied to the carrier 20*a*. When containers 22 are applied to the carrier 20*a*, the carrier 20*a* would normally foreshorten at the welded seam 50*a*, however, because the inner apertures 48*a* are shorter in length than the end apertures 46*a* and the length C is equal to or less than the two container diameters D, this causes the inner margins 38*a* proximate to the inner apertures 48*a* to stretch and cause a tension force therein. The tension force within the inner margins 38*a* proximate to the inner apertures 48*a* is transferred to the inner strut portions 64*a*, 68*a*. The inner strut portions 64*a*, 68*a* transfer the tension force to the outermost extents of the grip portion 58*a*, exerting the tension force along the length of the grip portion 58*a* and generally straightening the grip portion 58*a*.

The outer strap portions 62*a*, 66*a* are placed generally outside of the inner strut portions 64*a*, 68*a* to avoid the strap portions 64*a*, 68*a* transmitting tension force to the grip portion 58*a*. The first ends 67*a* of the outer strap portions 62*a*, 66*a* attach to the welded seam substantially away from first ends of the inner strut portions 63*a* to both stabilize the grip portion 58*a* and avoid transmitting force to the grip portion 58*a*.

Now that the specifics of the structure and the functioning of the carrier 20, 20*a* have been described, a description of the method for forming the carrier 20, 20*a* is briefly described. The method of forming the carrier is described with respect to the first embodiment of the carrier 20 for convenience in explanation. The second embodiment is formed in a like manner.

Preferably, the carrier 20 is formed from two separate rolls of wound plastic sheet material. The two plastic sheets are placed in an overlay configuration to provide a double thickness of sheet material. The sheets are simultaneously stamped by a die or the like to form: the handle portion 23; the container engaging portions 32, 34; the apertures 46, 48; the cutouts 54; and the tear strip 43. The stamped sheets are heat sealed in two positions along the length of the carrier 20. The first heat sealed bond is located at the welded seam 50 of the carrier 20 between the handle portion 23 and the container engaging portions 32, 34. A second heat sealed bond 56 is located along the grip portion 58 to prevent the two layers of the handle portion 23 from separating. Each formed and heat sealed carrier 20 remains attached to adjacent carriers at attachment regions 45 which are located at the outermost extents of the carrier 20. The finished carriers are wound onto a reel in the flattened condition. When it is desired to use a carrier it is unwound from the reel and severed from the adjacent carrier by suitable means.

It is to be understood that when the welded seam 50 is formed, a strip or layer of resilient, stretchable material (not shown), such as plastic, preferably low density polyethylene material, may be extruded between the inner margins 38 of the container engaging portions 32, 34. Thereafter, the inner margins 38 of the container engaging portions 32, 34 and the layer of extruded plastic are sufficiently melted and merged together by known means, preferably by heat sealing and fusing the layers together, to form a strong, three-layered, integral bond. This is disclosed in U.S. Pat. Nos. 5,487,465 entitled "Container Carrier" and owned by the assignee herein and which disclosure is incorporated herein by reference.

While preferred embodiments of the present invention are shown and described, it is envisioned that those skilled in the art may devise various modifications of the present invention without departing from the spirit and scope of the appended claims.

The invention claimed is:

1. In combination, a plurality of container and a flexible plastic carrier comprising:

each said containers has a predetermined diameter, said carrier comprising container engaging portions for holding said plurality of containers and a handle portion attached to said container engaging portions at a welded seam, said handle portion including a pair of strut portions and a grip portion, said handle portion extending generally perpendicular to said container engaging portions when said plurality of containers are attached thereto, each said container engaging portion being generally horizontal when containers are attached thereto and comprising a plurality of bands defining end apertures and at least one inner aperture for holding said containers therein, said container diameter defining a length which is greater than the length of said inner aperture, and said pair of strut portions being attached to said welded seam within the length defined by said container diameter held in said inner aperture, said end apertures being longer in length than said inner aperture such that when one of said containers is placed in said inner aperture, tension forces are transmitted to said welded seam, said pair of strut portions transferring said tension forces to said grip portion to generally straighten said grip portion.

2. The combination as defined in claim 1, wherein said carrier carries six containers.

3. The combination as defined in claim 1, wherein each said strut portion comprises a first end attached to said welded seam, a second end joined to said grip portion, and a curved portion connecting said first and second ends.

4. The combination as defined in claim 1, wherein said handle portion of said carrier further includes a pair of strap portions, each strap portion having a first end attached to said welded seam generally at opposite ends thereof and a second end attached to said grip portion.

5. The combination as defined in claim 1, wherein each container engaging portion of said carrier includes an outer margin and a tear strip provided on said outer margin.

6. The combination as defined in claim 1, wherein each said strut portion of said handle portion has a first end attached to said welded seam and a second end attached to said grip portion, said first and second ends being connected by a curvilinear portion including a pair of arcuate segments.

7. The combination as defined in claim 6, wherein said handle portion of said carrier further includes a pair of strap portions, each said strap portion having a first end attached to said welded seam and a second end attached to said grip portion, said first and second ends of each said strap portion being connected by a curvilinear portion.

8. The combination as defined in claim 1, wherein said container engaging portions include attachment regions at opposite ends thereof for attaching an adjacent carrier thereto.

9. In combination, a plurality of container and a flexible plastic carrier comprising:

each said containers has a predetermined diameter, said carrier comprising container engaging portions for holding said plurality of containers and a handle portion attached to said container engaging portions at a welded seam, said handle portion including a pair of strut portions and a grip portion, said handle portion extending generally perpendicular to said container engaging portions when said plurality of containers are attached thereto, each said container engaging portion being generally horizontal when containers are attached thereto and comprising a plurality of bands defining end apertures and at least a pair of inner apertures defining a length, each inner aperture for holding one of said containers therein, said container to be held in said inner apertures defining a length which is greater than the length of said inner apertures, said strut portions being attached to said welded seam within the length defined by said container diameter held in said inner apertures, said end apertures being longer in length than said inner apertures such that when said containers are placed in said inner apertures, tension forces are transmitted to said welded seam, said strut portions transferring said tension forces to said grip portion to generally straighten said grip portion.

10. The combination as defined in claim 9, wherein said carrier carries eight containers.

* * * * *